United States Patent [19]

Bay

[11] Patent Number: 4,784,318

[45] Date of Patent: Nov. 15, 1988

[54] METHOD AND APPARATUS FOR CUTTING A PAPER OR FOIL WEB INTO VARIOUSLY-SIZED RECTANGLES

[76] Inventor: Otto Bay, Luzernstrasse 45, CH-4553 Subingen, Switzerland

[21] Appl. No.: 20,466

[22] Filed: Mar. 2, 1987

[30] Foreign Application Priority Data

| | | | |
|---|---|---|---|
| Mar. 7, 1986 | [CH] | Switzerland | 945/86 |
| May 7, 1986 | [CH] | Switzerland | 1880/86 |
| Sep. 1, 1986 | [CH] | Switzerland | 3497/86 |

[51] Int. Cl.[4] ..... B26D 5/38

[52] U.S. Cl. ..... 234/2; 83/80; 83/106; 83/302; 83/371; 83/408; 83/430; 234/40; 234/46; 234/50

[58] Field of Search ..... 234/2, 38, 49, 50, 46, 234/40; 83/80, 302, 371, 106, 44, 45, 47, 27, 408, 482, 430

[56] References Cited

U.S. PATENT DOCUMENTS

| | | | |
|---|---|---|---|
| 1,663,788 | 3/1928 | Zimniewicz | 83/430 |
| 2,412,047 | 12/1946 | Huck | 83/430 |
| 2,474,299 | 6/1949 | Atkisson et al. | 83/430 X |
| 2,815,077 | 12/1957 | Pechy | 83/430 |
| 3,041,907 | 7/1962 | Gallagher, Jr. | 83/482 |
| 3,290,976 | 12/1966 | Grody | 83/302 |
| 3,706,373 | 12/1972 | Smith | 83/106 X |
| 3,728,920 | 4/1973 | Gardner et al. | 83/106 |
| 4,009,956 | 3/1977 | Ritzerfeld | 83/482 X |
| 4,506,824 | 3/1985 | Bartz | 83/371 X |

*Primary Examiner*—Frank T. Yost

*Attorney, Agent, or Firm*—Frishauf, Holtz, Goodman & Woodward

[57] ABSTRACT

Rectangular drawings of standard dimensions or formats can be automatically cut out of a continuous paper or plastic web (1) by a transverse cutter (9) and a plurality of longitudinal cutters (26), as directed by coding (20) on the edge of the web. The cut-off strips (23) of scrap made by transverse cutter (9) are directed away by a movable deflector (13). Additional deflectors (62) are provided downstream, in web motion direction D, of the longitudinal cutters (26) and serve to separate the scraps (23, 25) produced by the longitudinal cutters from the drawing forms (A0-A4) which have been trimmed on all four sides. Thus, manual separation of the drawings from the surrounding scrap is obviated.

7 Claims, 8 Drawing Sheets

METHOD AND APPARATUS FOR CUTTING A PAPER OR FOIL WEB INTO VARIOUSLY-SIZED RECTANGLES

The present invention relates generally to a method and apparatus for cutting a web into variously-sized rectangles, and, more particularly, to a system in which the edge of the web bears coding, which indicates to the apparatus what kind or format of rectangle to cut next.

Background

In the case of paper webs which come out of a plotter printed with mechanical drawings, graphics, and the like of various formats and sizes in a random sequence, there is a need to cut out these formats automatically to the right size and shape. Depending upon the drawing format, this requires longitudinal and transverse cuts of the paper web at differing places. Hitherto, it has been customary to laboriously cut out these drawing formats manually or with simple cutting apparatus.

The Invention

Accordingly, it is an object of the present invention to automatically make longitudinal and transverse cuts, in a relatively long paper or plastic web, corresponding to the sequence of various formats printed on the web or otherwise selected. It is a further object to automatically remove the scraps or cut-off portions, so that only the desired formats remain.

Briefly, the edge of the web is coded, and this actuates a transverse web cutter and at least one of a plurality of longitudinal cutters disposed across the width of the web. Preferably, the coding also controls the removal of the scraps. Thus, a continuously moving paper or plastic web, for example from a computer plotter or the like, having various drawing formats thereon in random order, can be correctly cut out, trimmed, and separated without any manual labor.

DRAWINGS

DETAILED DESCRIPTION

Figure 1:
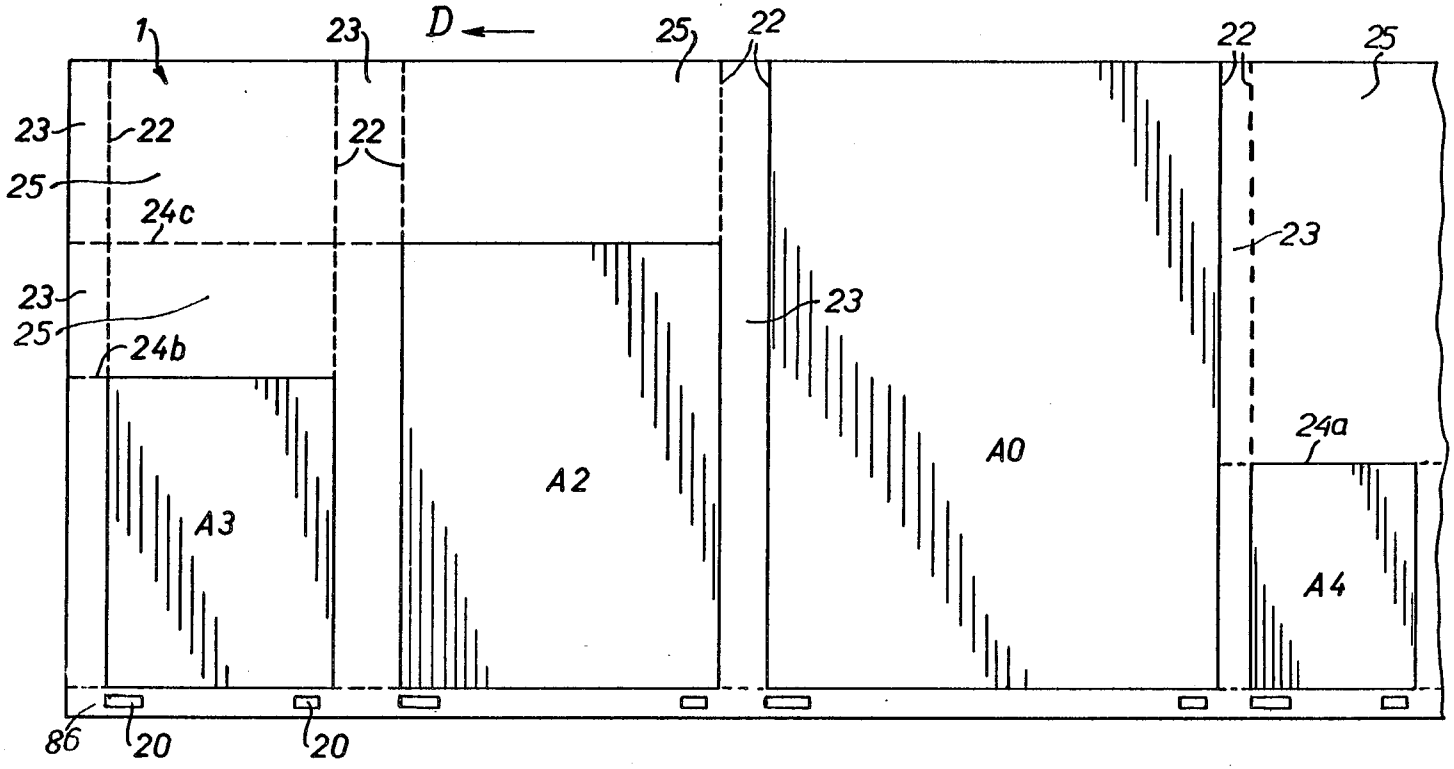
FIG. 1 is a plan view of a coded web bearing exemplary rectangular formats according to German Industrial Standards (DIN) A0, A2, A3, and A4, and indicating the locations of the necessary cuts.

The method and apparatus of the present invention serve to cut out various rectangular drawing formats from an "endless" paper, foil, or plastic web 1. Such drawings or the like are continuously applied to the web by a plotter or the like. The individual different drawing forms appear in random order, as indicated in FIG. 1 by the German Industrial Standard (DIN) formats A3, A2, A0, and A4 (the latter being familiar to Americans as "PCT" size).

In order to cut, from web 1, drawing forms of the right size, one must make transverse cuts 22 and longitudinal cuts 24*a*, 24*b*, and 24*c*, respectively. The control of the cutting apparatus for carrying out these longitudinal and transverse cuts is by means of codes 20, which are provided for each form on the edge of the web 1 from the plotter (not shown).

Figure 2:
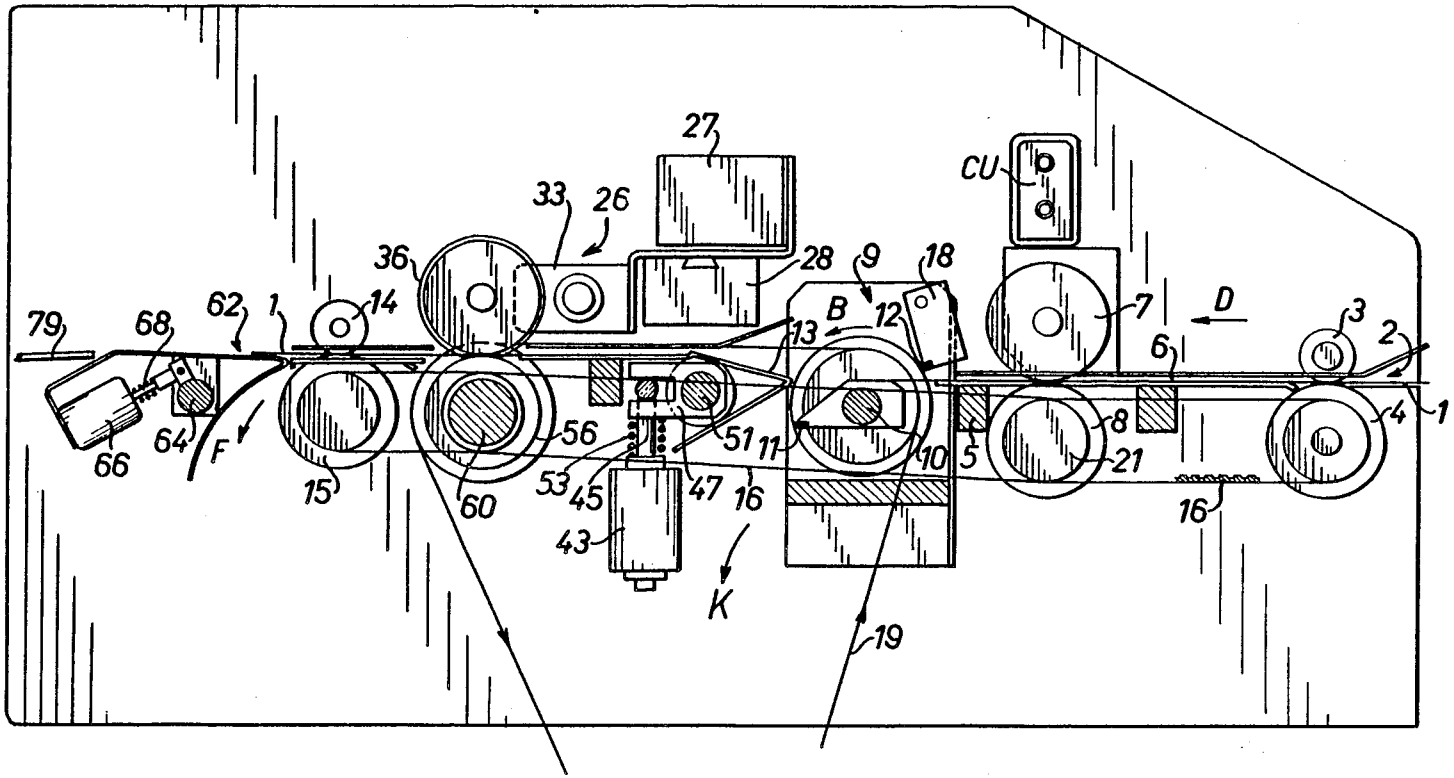
FIG. 2 is a schematical vertical cross-section of the apparatus of the present invention.

FIG. 2 shows the apparatus with which these longitudinal and transverse cuts can be carried out. The paper web 1, coming from the plotter, feeds into an inlet slot 2 and is gripped by two opposing pressure rollers 3, 4. Paper web 1 is fed in a horizontal channel 6 for transport in the direction of arrow D, and passes a sensor 5, which reads the codes 20 disposed on the edge of web 1. Downstream are two more opposing pressure rollers 7, 8, one of which is connected with an electric clock 21, which transmits signals to a control device, dependent upon the rotation of these pressure rollers 7, 8 and hence corresponding to the advancing movement of paper web 1.

Paper web 1 advances thereafter to a transverse cutter 9, which comprises a cutter spindle 10 with transverse cutter blade 11 rigidly secured thereto and a counterblade 12 rigidly secured to a stationary holder 18. This cutter spindle 10 turns in the direction of arrow B whenever a corresponding command is received from the control device. Whenever a transverse cut 22 is to be made, a clutch is engaged. The clutch may be of conventional construction. This transverse cutter 9 extends over the entire width of paper web 1 and, upon rotation of cutter spindle 10, carries out the transverse cuts 22 shown in FIG. 1. Directly following this transverse cutter 9 is disposed a selectively actuable deflector 13, which serves to prevent the cut-off striplike intermediate pieces 23—which are scraps—from passing on to the following longitudinal cutting unit, and to assure that the scraps are carried away in the direction of arrow K.

Deflector 13 is cross-sectionally wedge-shaped and has an apex extending across the entire width of paper web 1. For pivoting of the deflector, an electromagnet 43 and a spring-loaded tie rod 45 are provided. These co-operate with a connecting member 47 which is rotatable about a shaft 51. Whenever electromagnet 43 attracts, tie rod 45 moves downward against the force of a restoring spring 53, causing the apex of deflector 13 to move upward and allow the intermediate strip 23 cut off by transverse cutter 9 to pitch downward in the direction of arrow K.

The trimmed pieces, which bear the drawings, pass next to longitudinal cutting units 26, which will be described below with reference to FIGS. 3 through 5. A plurality of these selectively actuable longitudinal cutting units 26 are provided, spaced across the width of web 1. They are selectively actuated, only if the form calls for a corresponding longitudinal cut, e.g. cuts 24*a*, 24*b* or 24*c* as shown in FIG. 1. Of course, the cuts depicted are merely examples and could be widened or narrowed, or spaced at different intervals, according to the format desired.

Figure 3:
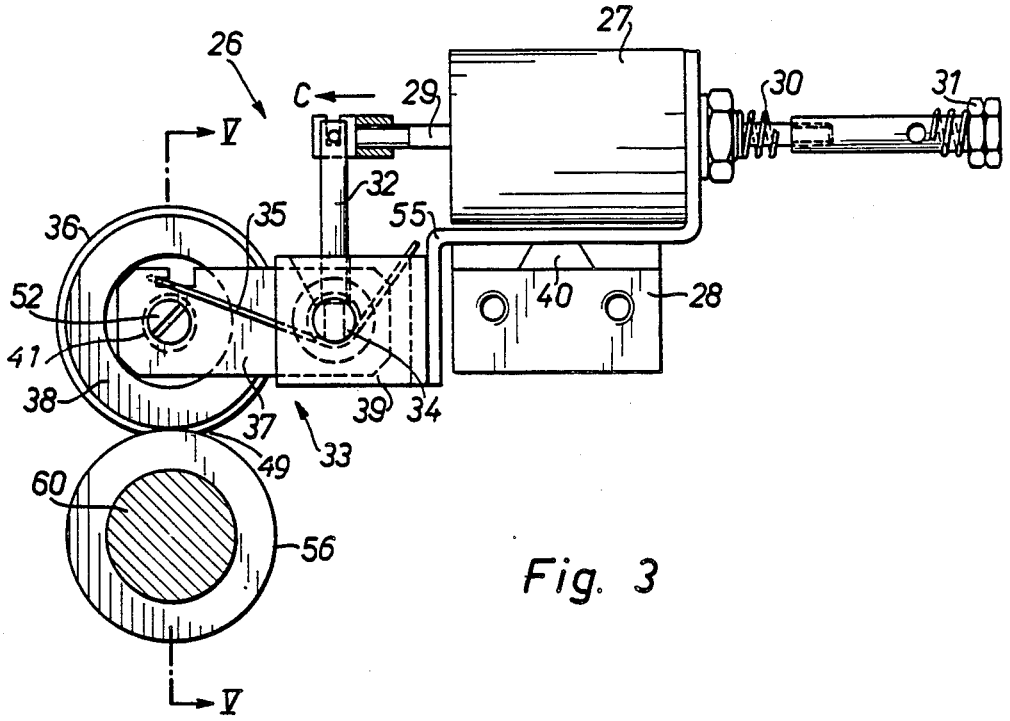
FIG. 3 is a side view of a longitudinal cutting unit.
Figure 4:
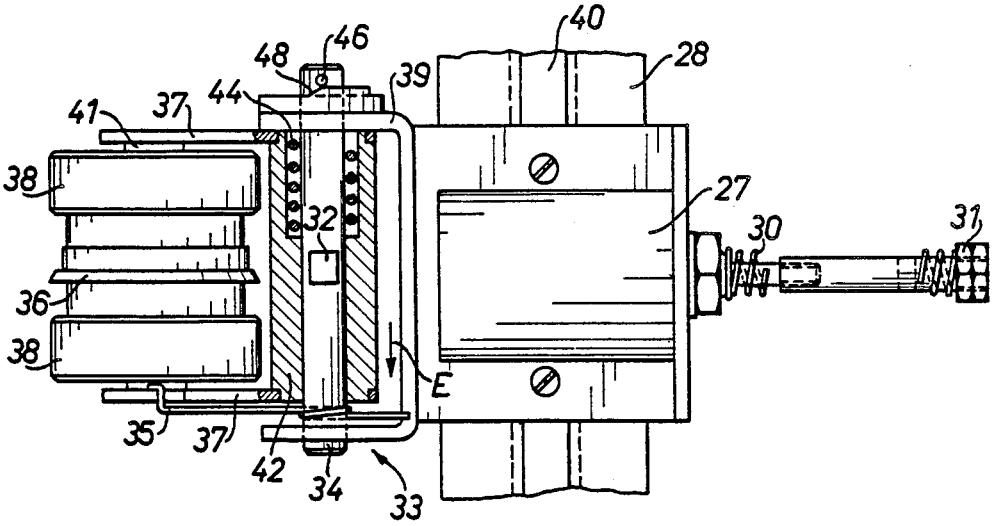
FIG. 4 is a top view of the cutting unit of FIG. 3.
Figure 5:
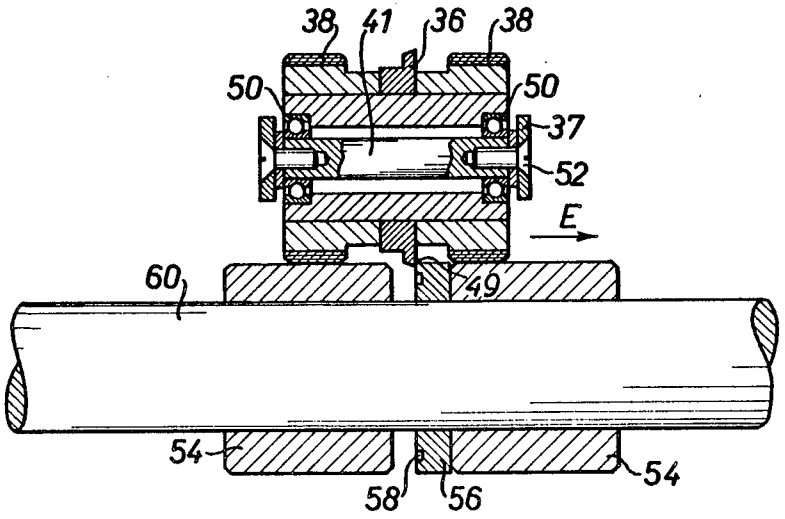
FIG. 5 is vertical cross-section through the cutting unit along line V—V of FIG. 3.

As shown in FIGS. 3–5, these longitudinal cutting units 26 each comprise an upper annular cutter 36 and a lower annular cutter 56, which or overlap at a cutting zone or edge or gap 49, as best seen in FIG. 5. Thereafter, the rectangular form, cut on all four sides, passes between further pressure rollers 14, 15, shown in FIG. 2, toward a second deflector 62, shown in FIGS. 8 and 9, which serves to deflect away scrap 25, shown in FIG. 2. The drawing sheet trimmed to the right format, remains and can be fed further, for example to a folding machine (not shown).

Figure 10:
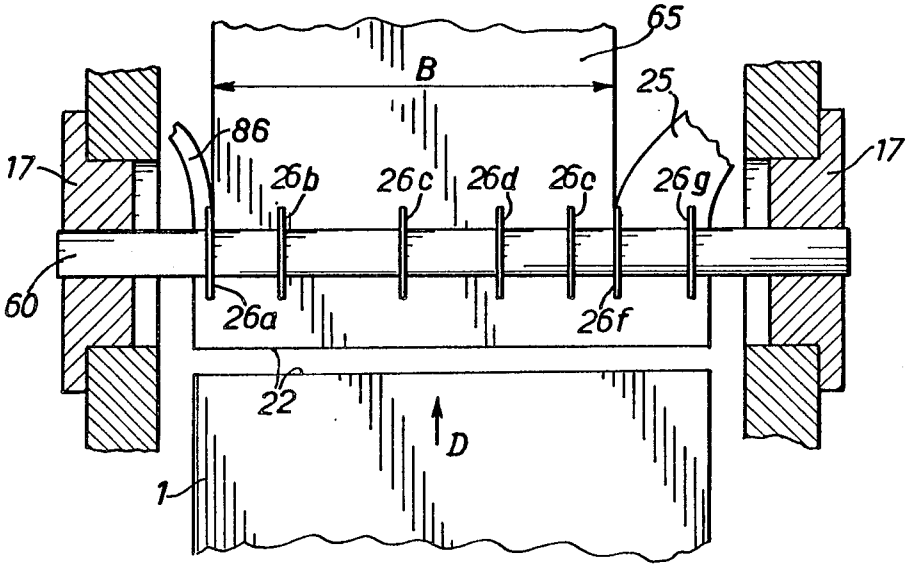
FIG. 10 is a schematic top view of the longitudinal cutting unit with its plurality of spaced cutters.

As shown in FIG. 2, transverse cutter 9 is driven by a drive belt or chain 19, preferably a toothed belt, from a drive motor, which is not shown and may be of any suitable conventional construction. Drive belt 19 preferably also travels over shaft 60 of annular cutter 56, from which the rotary motion is transferred by a further toothed belt 16 to pressure rollers 14,15. The various rotary shafts are supported at both ends by sidewalls 17, as shown in FIG. 10.

Cutter operation

The form and operation of an individual cutting unit 26 will now be described, with reference to FIGS. 3–5. A plurality of such units 26 are spaced across the width of paper web 1. The intervals are preferably chosen so that the DIN-standard sizes will be cut out. These units rest on a crossrail 28 at intervals such that the transverse cuts 24*a*–24*c*. can be carried out at the predetermined places. An electromagnet 27 is secured by screws to crossrail 28, which rides in a longitudinal groove 40.

Thus longitudinal cutting units 26 can be moved at will along crossrail 28 and secured in the desired position. Electromagnet 27 has an axially movable core or armature rod 29, which moves in the direction of arrow C, shown in FIG. 3, when current to the magnet windings is turned on. Restoring force is provided by a spring 30 on the other side of the coil, and the spring force can be adjusted by adjusting nuts 31 at the remote end of the spring. As shown in FIGS. 3 and 4, a rocker 33 is provided, connected to the electromagnet 27 by a somewhat Z-shaped right angle bracket 55. Core rod 29 is movably connected to a bolt 32 which runs at right angles to it. Bolt 32 projects radially from, and is screwed to, a rocker axle 34, preferably horizontal, which in turn is supported in a U-shaped bracket 39. Rocker axle 34 serves as a rotatable mounting for rocker 33, which suppports upper annular cutter 36 and the two parallel support rollers 38 disposed on either side of it, as shown in FIGS. 4–5.

As shown in FIG. 5, support rollers 38 and annular cutter 36 are rotatably mounted on ball bearings 50 on a shaft 41. A screw 52 in each end of shaft 41 passes through a support element 37. The remote end of each support element 37 is rigidly secured to a sleeve or bushing 42 which surrounds and is rotatable with respect to rocker axle 34.

Rocker 33 is urged upward by a torsion spring 35, which wraps around one end of rocker axle 34, as shown in FIG. 4, and has two radially projecting ends, one of which engages a notch in the top of support element 37, as shown in FIG. 3, and the other of which engages the top of U-shaped bracket 39.

Sleeve or bushing 42 is formed with an annular recess at one end, leaving between it and rocker axle 34 an interstitial space, in which is disposed a coil spring 44, as shown in FIG. 4. Coil spring 44 is under compression and therefore urges sleeve 42 and the entire rocker 33, including annular blade 36 in the direction of arrow E, that is, horizontally toward engagement of the side of upper annular blade 36 with the side of lower annular cutter 56, as shown in FIG. 5.

A pin 46 projects from the protruding end of rocker axle 34 adjacent spring 44, and the spring bias urges this radially projecting pin or cam 46 against a curved cam race 48 secured to the outside of U-shaped bracket 39. The thickness of the cam race varies at different rotational positions of rocker axle 34 and its cam pin 46, as shown in FIG. 4.

When current is directed through electromagnet 27, core rod 29 moves axially outward in the direction of arrow C and pushes bolt 32 forward, thereby making rocker 33 execute a downward tilting movement against the force of torsion spring 35. This brings support rollers 38 into contact, as shown in FIG. 5, with counter-pressure rollers 54 mounted on driven shaft 60. Lower annular cutter 56 is disposed approximately centrally around shaft 60, and rotates with it. Upon depression of rocker 33, the outer edge of upper annular blade 36 dips somewhat below the topmost point of lower annular cutter 56, to overlap and rotate alongside it, as shown in FIG. 5.

In order to prevent damage to blades 36, 56 during depression of rocker 33, the axial movement of upper blade 36 toward lower blade 56, in the direction of arrow E, is accomplished only after depression of the rocker. Once support rollers 38 have come into contact with counter rollers 38, further rotation of rocker axle 34 and its projecting pin 46 allows pin 46 to move onto the lower-thickness portion of cam race 48 (FIG. 4), and rocker axle 34 to move in direction E. Thereby, upper blade 36 moves into contact with the side face of lower blade 56, under the light pressure of coil spring 44. This prevents upper blade 36 from coming down upon the top surface of blade 56 and damaging one or both blades as the rocker 33 tilts down.

Control of the actuation of longitudinal cutting units 26 is accomplished by the codes 20 on the edge of paper web 1, codes which are preferably placed there by the same plotter or printer which makes the drawings or graphics to be cut out. These codes 20 are preferably the well-known bar codes (as used for supermarket scanning and the like) and are read by a sensor 5 and transformed in a control unit CU into control signals for the electromagnets and drive motors. The control unit may be of any suitable conventional construction. The codes control both the transverse cutter 9 and the selection of at least one longitudinal cutting unit 26. Instead of having two codes for each form, one adjacent the beginning and one adjacent the end, one could also employ a single code which contains all necessary information.

Figure 6:
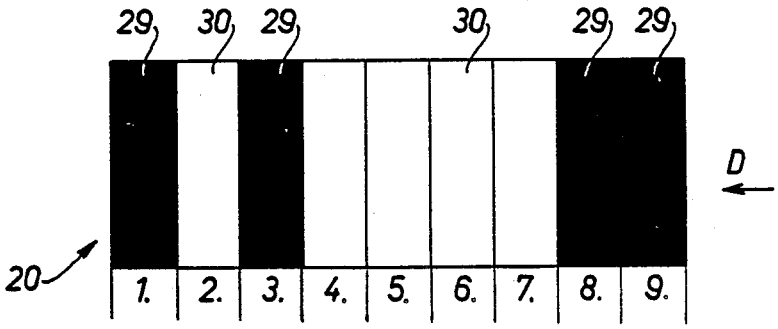
FIG. 6 illustrates an example of a web edge coding scheme.

As shown in FIG. 6 the codes provided on the sheet or web edge may comprise a series of regularly spaced black and white stripes, fields, or bars. These fields are sampled or picked up by sensor 5 during transport and corresponding signals go to the control unit CU. Preferably, the first field 29 is always black and actuates the clutch for transverse cutter 9, to produce a first cut across the entire width of web 1. The next field 30 is devoted to the code for first deflector 13. If this field 30 is white, electromagnet 43 is not excited and deflector 13 remains at rest, as shown in FIG. 2, so that a segment transported in the direction of arrow D is fed to longitudinal cutters 26. Conversely, if field 30 is black, electromagnet 43 is excited by the control unit and intermediate segment 23 is pitched down as scrap in the direction of arrow K and collected in a receptacle.

The directly following fields 29, 30 are devoted to the individual longitudinal cutters 26, and seven possible control commands are provided for seven longitudinal cutters 26. It is clearly possible to provide arbitrarily any desired number of such fields and/or cutters.

Figure 7:
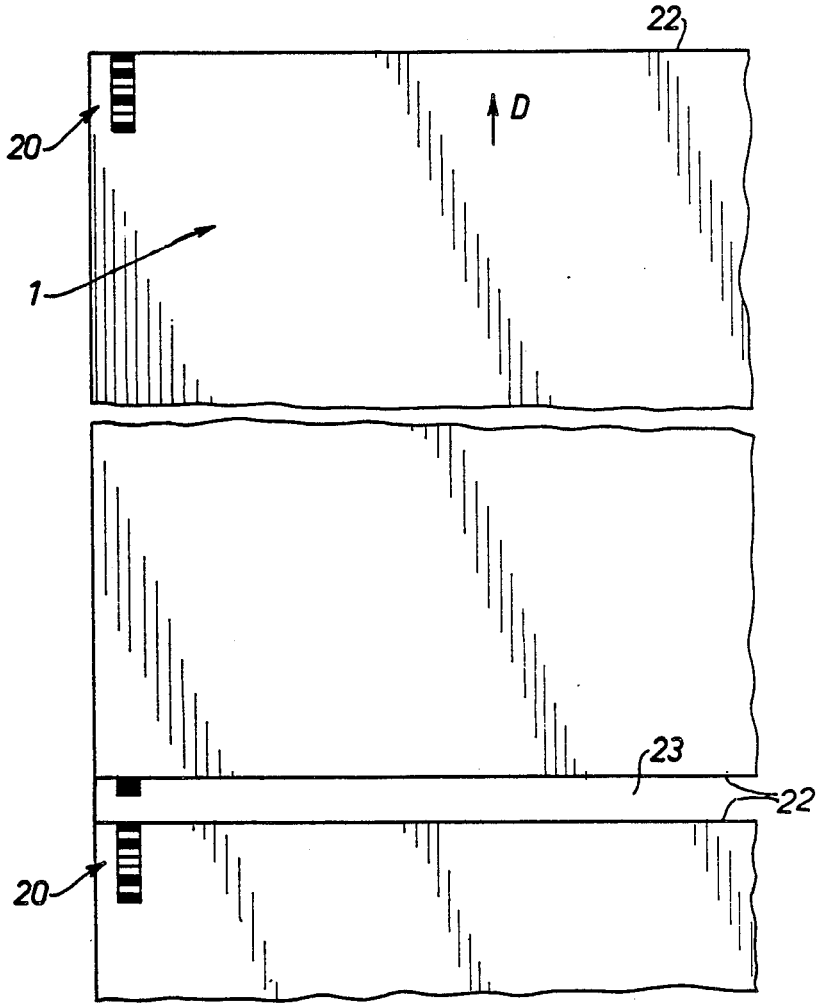
FIG. 7 illustrates such coding applied to a web.

FIG. 7 illustrates that the first dark field 29 devoted to the transverse cutter is preferably disposed in a corresponding position on the leading edge 22 of the piece to be cut out. The cut on the trailing edge is directed by a code in the form of a black field 29 adjacent what will become the trailing sheet edge. The leading edge 22 of the following sheet is produced at a short interval, e.g. 5 or 6 millimeters, by making the next transverse cut 22. As before, another set of codes on the edge directs the associated longitudinal cuts, if any, as shown.

A suitable width of code fields 29 or 30, measured in the longitudinal direction of the web, is in the neighborhood of 1.8 millimeters, so that, for example, nine fields would mean a total set of bar codes about 16.2 millimeters long.

If the cut of the transverse cutter 9 simultaneously produces the trailing edge of one sheet and the leading edge of the following sheet, there is of course no intermediate strip 23 and deflector 23 remains in a flat, inactive position.

The second deflectors 62 downstream, with reference to web motion direction D, of the longitudinal cutters, serve to divert the scraps, so that only the trimmed rectangular formats 65 with their drawings remain, and hand-separation of scrap is avoided.

Figure 8:
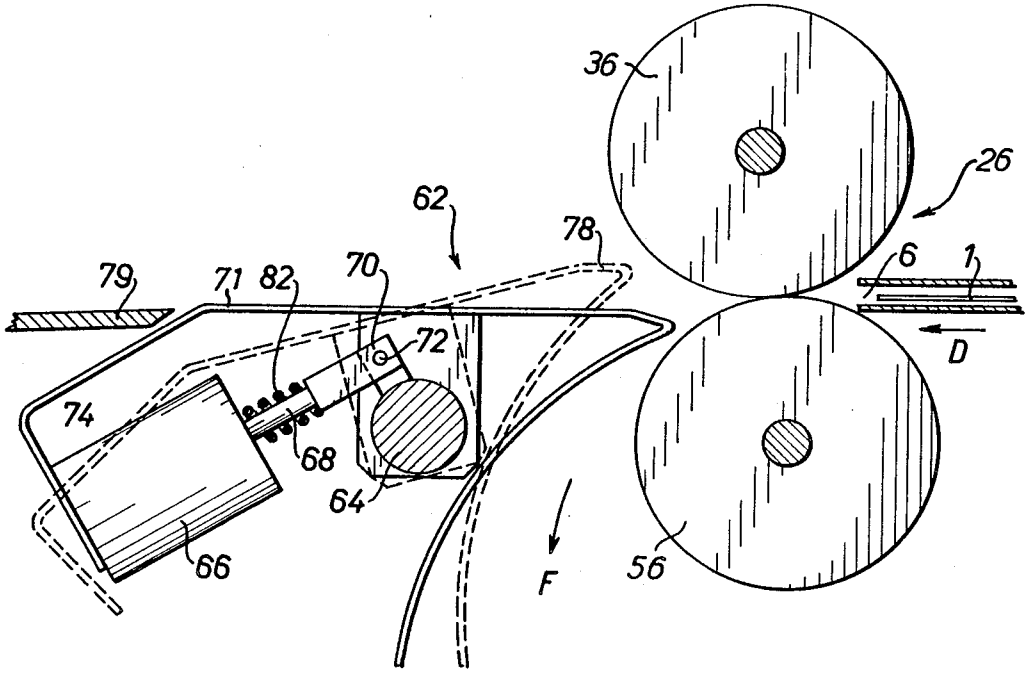
FIG. 8 is a vertical section through a deflector disposed downstream of the longitudinal cutters.

As shown in FIG. 8, each of the second deflectors 62 downstream of longitudinal cutters 26 is rotatable about a stationary horizontal axis 64. Approximately between the lateral positions of each pair of adjacent longitudinal cutters, there is provided a separate deflector 62, which is individually and independently tiltable or rotatable. The tilting of each deflector 62 is done by an associated electromagnet 66 disposed within its outer contour 71. A flange 70 is rigidly connected to and projects from axle 64. Flange 70 is rotatably connected to a link rod 72 which extends from the core rod 68 of magnet 66. The side of the electromagnet 66 remote from core rod 68 is supported on a flange 74 of deflector 62 When current is supplied to electromagnet 66, core rod 68 is projected. Since the core rod 68 is rotatably secured to the unmovable link rod 72, the stator of electromagnet 66 pushes deflector 62 upward into the position shown in phantom in FIG. 8. In this position, the wedge-shaped apex 78 extends into the horizontal motion path of paper web 1 and produces a pitching of scraps 25 into channel F. Upon de-energization of electromagnet 66, a spring 82 mounted coaxially around core rod 68 pulls deflector 62 back into the inactive position shown in solid lines.

The pivoting of deflectors 62 could, as an alternative embodiment, be accomplished by direct mechanical coupling with the tiltable cutting blades 36.

Figure 9:
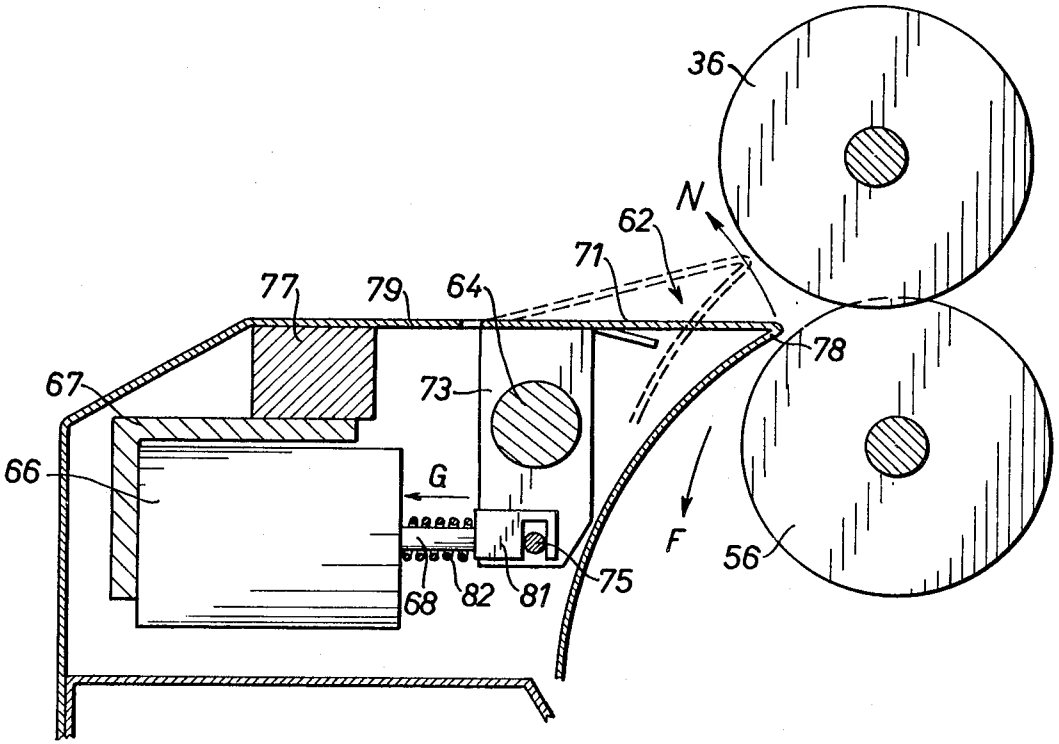
FIG. 9 is a vertical section through an alternative embodiment of deflector disposed downstream of the longitudinal cutters.

FIG. 9 illustrates an alternative embodiment of deflector actuation. The electromagnets 66 of this embodiment rest here on a common continuous, horizontal member 67 which is rigidly secured in the machine room. Two lugs or flanges 73, preferably vertically extending, are rigidly connected to each deflector 62. The lugs 73 are mounted with minimal play on a horizontal axle 64, about which they and the deflector 62 are rotatable. The core rod 68 of each electromagnet 66 has a remote end provided with a crosswise projecting pin 75 which engages in a notch of flanges 73, preferably at the bottom thereof. As long as current flows in electromagnet 66, core rod 68 is retracted in the direction of arrow G into the magnet, and apex 78 of deflector 62 is rotated, contrary to the direction of arrow N, into the position shown in FIG. 9 in solid lines.

A restoring spring 82, preferably mounted coaxially around core rod 68, assures that deflector 62 remains open whenever current is not flowing in the electromagnet 66, that is, remains in the upwardly rotated position shown in FIG. 9 in phantom. In this position, scraps 25 are deflected downward in the direction of arrow F and collect in a waste receptacle. Whenever current flows in electromagnet 66, deflector 62 pivots into the position shown in FIG. 9 in solid lines, and any correctly trimmed rectangular drawing sheet fed will continue on and reach an output table or platform 79, whence it can be further handled, for example by a folding machine.

The electromagnets 66 are preferably commonly switched in parallel with the electromagnets 27 of the respective longitudinal cutters, so that additional control devices are obviated, in view of the fact that a deflector 62 must be associated with each rocker 33.

FIG. 10. schematically illustrates, as an example, seven longitudinal cutters 26*a*, 26*b*, 26*c*, 26*d*, 26*e*, 26*f*, 26*g*. These correspond to the cutters in FIGS. 3-5, in each of which the upper annular cutter 36 can be selectively lowered by actuation of the associated electromagnet 27 whenever a longitudinal cut must be carried out. In the example illustrated in FIG. 10, only longitudinal cutters 26*a*, 26*f*, and 26*g* are in their lowered, active cutting position, while the others are in a non-cutting position. Since the drawing format 65 here must have breadth B, left and right scrap strips 86 and 25 are cut off from web 1 and deflected by upwardly pivoted deflectors 62 in the direction of arrow F. Thereby, drawing forms 65, correctly trimmed on all four sides, reach output table 79.

Whenever a narrower drawing form 65 is to be cut out, the breadth is determined by one of the remaining longitudinal cutters 26, and the corresponding wider o narrow scrap is deflected by other upwardly pivoted deflectors 62. The actuation of the second deflectors 62 can thus be done simultaneously and parallel to the bringing into cutting position of the longitudinal cutters 26, so that no additional coding or control means for the actuation of these deflectors 62 is necessary.

Since one always trims off from web 1 a small edge strip 86, bearing the codes 20, the outermost deflector can be made stationary and left in the upwardly pivoted position.

Since the longitudinal cutters 26 are slidable in the horizontal direction, drawing forms of any desired breadth can be cut, although one usually restricts oneself to standard dimensions.

By clever combination of various formats, it is possible to keep the waste relatively small, for example by putting an A3 format next to a rotated A4 format.

In place of webs of paper, foils or webs of inherently rigid or self-supporting plastic could also be used.

Various changes and modifications are possible within the scope of the inventive concept.

I claim:

1. In a web-cutting machine having a sensor (5), a transverse cutter (9), deflector means (13, 62), and a plurality of longitudinal cutters (26) spaced across the web (1), a method of cutting variously-sized rectangular forms from said web, comprising the steps of sensing coding (20) disposed on an edge of said web, making at least one cut (22) transversely across the web (1) to separate off a piece having a length specified by said coding;

actuating, in response to said coding (20), a first one of said deflector means, disposed downstream of said cut (22), thereby deflecting scrap (23) produced during said cut (22);

selectively actuating at least one of said plurality of longitudinal cutters 926) and thereby producing a corresponding number of longitudinal cuts (24*a*, 24*b*, 24*c*) in said piece, in accordance with said coding and with a format defined thereby; and selectively actuating, in response to said coding (20), at least one of a plurality of second deflector means disposed downstream of said longitudinal cutters (26), thereby deflecting away scraps 25 produced during said longitudinal cuts.

2. A web-cutting machine, for cutting variously-sized form s from a web (1) bearing codes for control of cutting and at least one code for control of at least one deflector (13, 62) for deflection of scrap (23, 25, 86), having a sensor (5) reading cutting codes (20) from said web (1);

a transverse cutting unit (9) making transverse cuts (22) completely across said web (1);

a first deflector (13) downstream, in web motion direction (D), of said transverse cutting unit (9);

a plurality of longitudinal cutting units (26) spaced across the web (1) and selectively movable between a cutting position and a non-cutting position;

a set of second, independently movable deflectors (62) downstream of said longitudinal cutting units (26) for separation of scraps (23, 25, 86) from trimmed forms (65); and a control unit (CU) having an input connected to said sensor and outputs connected to said transverse and longitudinal cutting units (9, 26), controlling said cutting units in accordance with said codes (20).

3. A web-cutting machine according to claim 2, wherein a plurality of said longitudinal cutting units (26) are provided, centered in a common plane transverse to said web (1) and located downstream, in web transport direction (D), of said transverse cutter;

each of said longitudinal cutting units (26) comprises a first annular cutter (26);

a second, counter cutter (56); and mechanical positioning means for moving said cutters (36,56) into overlapping position, including a rocker (33) and an electromagnet (27) actuating each of said longitudinal cutting units (26), and wherein said counter cutter (56) is secured to a driven shaft (60); said annular cutter (36) has a rotational axis parallel to said driven shaft (60) and is supported on said rocker (33);

each said electromagnetic is controlled by said control unit for selectively moving said first cutter (36) into an overlapping position relative to said second cutter (56); and axial moving means are provided for effecting a relative axial movement between said first (36) and second (56) cutters, to thereby form a cutting edge.

4. A web-cutting machine according to claim 2, wherein at least one support roller (38) is mounted next to said annular cutter (36) on a common shaft (41);

at least one counter roller (54) is mounted next to said counter cutter (56) on a common shaft (60);

said support and counter rollers being engageable for transmission of rotation;

said rocker (33) has an axle (34) with a radially projecting member (32) which is in a drive connection with said electromagnet (27); and said rocker axle (34) is coupled to a cam surface (48) which, after said support and counter rollers engage, imparts an axial motion (E) to said rocker axle (34) and to said annular cutter (36);

a first spring (35) urges said rocker (33) in an outward direction from cutting position;

said rocker axle (34) has a projecting cam pin (46);

a second spring (44) urges said cam pin (46) in a direction against said cam surface (48)

said rocker axle (34) runs through said cam surface (48); and said cam pin (48) is coupled to said electromagnet (27) for movement along said cam surface (48) to form a cutting edge between said overlapping cutter (36, 56) after energization of said electromagnet.

5. A web-cutting machine according to claim 2, wherein, in addition to codes for control of cutting, at least one code is provided for control of at least one deflector (13, 62) for deflection of scrap (23, 25, 86).

6. A web-cutting machine according to claim 2, wherein, a plurality of said second deflectors (62) are provided, downstream of and between said longitudinal cutting units (26) and these second deflectors (62) each have an apex (78) movable by an electromagnet (66) between a first position supporting sheet transport in web motion direction and a second position blocking sheet transport and thereby deflecting scrap (25, 86).

7. A web-cutting machine according to claim 2, wherein, said set of second deflectors (62) assume said second, scrap-deflecting position when their electromagnets (66) are not excited.

* * * * *